US005967304A

United States Patent [19]

MacKay et al.

[11] Patent Number: 5,967,304

[45] Date of Patent: Oct. 19, 1999

[54] ROTARY ELECTRIC SWITCH HAVING A MOMENTARY SWITCH POSITION

[75] Inventors: Peter MacKay, Warwick; Levon Galpchian, Cranston, both of R.I.

[73] Assignee: Tower Manufacturing Corporation, Providence, R.I.

[21] Appl. No.: 09/185,844

[22] Filed: Nov. 4, 1998

[51] Int. Cl.[6] ..... H01H 19/00

[52] U.S. Cl. ..... 200/565; 200/11 R; 200/564

[58] Field of Search ..... 200/6 R, 11 R–11 TW, 200/564–570, 336

[56] References Cited

U.S. PATENT DOCUMENTS

| | | | |
|---|---|---|---|
| 3,748,419 | 7/1973 | Torrey et al. | 200/155 R |
| 3,882,293 | 5/1975 | Naples et al. | 200/154 |
| 3,892,931 | 7/1975 | Lockard | 200/11 R |
| 5,310,974 | 5/1994 | Churchill et al. | 200/566 |
| 5,326,944 | 7/1994 | Garcia | 200/11 R |
| 5,595,290 | 1/1997 | Hsieh | 200/571 |
| 5,728,982 | 3/1998 | Rao et al. | 200/6 R |
| 5,750,947 | 5/1998 | Rao et al. | 200/6 R |

*Primary Examiner*—Michael A. Friedhofer
*Attorney, Agent, or Firm*—Kriegsman & Kriegsman

[57] ABSTRACT

A rotary electric switch having push-in wire terminals includes a hollow plastic housing having a recessed base and a cover member. The cover member comprises a top surface, a bottom surface and an annular boss which is shaped to define a central bore. A plurality of resilient stationary contacts are positioned in the base. A switch handle is rotably mounted on the base between the plurality of resilient stationary contacts. The switch handle comprises a disc-shaped rotor having a top surface and a bottom surface. The switch handle further comprises an elongated shaft and an arcuate rotor stop which are formed on its top surface, the elongated shaft protruding through the central bore in the cover member and the arcuate rotor stop being disposed within a rotor recess formed in the bottom surface of the cover member. A rotatable contactor is mounted on the bottom surface of the rotor of the switch handle and serves to selectively contact the stationary contacts. A coiled wire is mounted on the top surface of the rotor and is held in a pre-loaded position by the rotor stop, the coiled wire being disposed within a coiled wire recess formed in the bottom surface of the cover member. In use, rotation of the switch handle causes the rotatable contactor to selectively contact the stationary contacts in such a manner so as to provide the switch with a plurality of different settings, such as a momentary setting, an off setting and low and high power stable state settings.

14 Claims, 6 Drawing Sheets

| POSITION | 1 | 2 | 3 | 4 |
|---|---|---|---|---|
| SETTING / FUNCTION | PULSE | OFF | LOW | HIGH |
| POSITION OF SWITCH HANDLE (WITH COILED WIRE) RELATIVE TO COVER MEMBER OF HOUSING |   |   |  |   |
| POSITION OF SWITCH HANDLE (WITHOUT COILED WIRE) |   |  |   |   |
| POSITION OF MOVABLE CONTACT RELATIVE TO STATIONARY CONTACTS (CONTACT POSITIONS) |   |   |  |   |

ROTARY ELECTRIC SWITCH HAVING A MOMENTARY SWITCH POSITION

BACKGROUND OF THE INVENTION

The present invention relates generally to rotary electric switches and, more particularly, to rotary electric switches having a momentary switch position.

Rotary electric switches are well-known in the art and are commonly used to control alternating current circuits for a variety of applications. For example, rotary electric switches are particularly useful in connection with multispeed electric motors for household appliances, such as food processors, blenders, fans and the like.

One type of rotary electric switch which is well-known in the art includes a hollow housing which is preferably miniature in size. The housing is usually made of plastic and includes a recessed base and a cover member. A rotatable contactor is centered in the base and is controlled by a switch handle or shaft. A plurality of resilient stationary contacts are positioned edgewise in the base around the rotatable contactor for making and breaking the several circuits through the switch.

Each stationary contact is generally in the shape of a Z, where the ends of the Z represent a locking tongue and a spring contact finger which are joined together by an intermediate arm. The two bends in the Z shaped stationary contact, one where the locking tongue engages the intermediate arm and the other where the intermediate arm engages the contact finger, are supported in opposite pockets in the base so that the intermediate arm will flex slightly to distribute the bending stresses exerted on both the locking tongue and the spring finger.

The locking tongue on each stationary contact provides the switch with the capability of implementing push-in wire terminals. In particular, a wire to be connected to the switch is pushed through a wire receiving opening formed in the base, the wire receiving opening being partially covered by the free end of the locking tongue of the stationary contact. Once forced through the wire receiving opening, the wire will displace the locking tongue away from the opening which enables the wire to be fed into the base. Once the wire is sufficiently pushed through the opening, the locking tongue engages the side of the wire and effectively locks the wire within the switch between the stationary contact and a sidewall of the housing. When a pulling force is exerted to remove the wire from the switch, the wire tends to carry the tongue with it so that the locking tongue is pushed harder against the wire wedging it against the side wall of the plastic housing, the force of the wedging pressure increasing in proportion to the pulling force exerted on the wire.

U.S. Pat. No. 5,750,947 to C. P. Rao et al discloses a rotary electric switch having push-in wire terminals. The rotary electric switch includes a hollow plastic housing having a recessed base and a cover, the base having a plurality of wire receiving openings. A plurality of resilient stationary contacts are positioned in the base, each resilient stationary contact being generally Z-shaped and having a locking tongue at one end, an intermediate arm, and a spring finger at the opposite end from the locking tongue. Each resilient stationary contact is positioned in the base with its locking tongue overlying a wire receiving opening in a side wall in the housing. A rotatable contactor is mounted in the base between the spring fingers of the resilient stationary contacts. A plurality of conductive plates are disposed in the base, one conductive plate associated with each resilient stationary contact, each conductive plate contacting the resilient stationary contact at a location its intermediate arm and in addition preventing a wire inserted into the opening from touching the sidewall of the housing. The housing includes a number of projections and standoffs to provide adequate spacing between current carrying components on the switch.

The use of rotary electric switches with push-in wire terminals is desirable for two primary reasons. First, connecting the wires of the circuit into the switch is relatively simple. More specifically, the user simply inserts each wire through its associated wire receiving opening in the housing, the locking tongue serving to lock the wire within the switch and to preclude its removal. Second, the use of push-in wire terminals is relatively inexpensive when compared to the more complicated switches which are presently quite standard in rotary switches, such as spade terminals.

Rotary electric switches of the type described above are typically constructed to include multiple stationary switch positions. Stationary switch positions, also commonly referred to as snap-action contact positions or stable state positions, refer to the switch positions, or settings, which are assumed by the switch upon rotation of the switch handle and which remain in the particular position even after the rotative force has been removed from the switch handle. More specifically, for rotary electric switches of the type described above, the switch handle is engageable with the rotatable contactor and includes detent notches along its periphery which are engageable with the spring contact finger of the stationary contacts in order to lock the position of the switch handle in place.

Rotary electric switches having multiple stationary switch positions are well-known and are widely used in commerce. However, for many applications, especially those involving electric food mixers, it is frequently desirable to be able to produce an abrupt increase of power at a predetermined selected speed for a limited time period and then to release, or desist from, the predetermined speed of operation almost instantaneously. Accordingly, electric switches having momentary switch positions are well known in the art and are commonly used to produce a particular pulse of power which will instantaneously terminate upon release of the switching force by the user.

As can be appreciated, rotary electric switches having push-in wire terminals are often constructed to provide a momentary switch setting in addition to the multiple stationary positions. Specifically, a coiled wire, or spring, is often disposed between the switch handle and the base of the housing. One of the plurality of stationary contacts is removed from the base of the switch and the coiled wire is disposed within the region of the base in which the removed contact was previously disposed. Accordingly, the application of a rotative force on the switch handle to the momentary switch position causes the wire to wind up in torsion and engage a portion of the base of the housing. Because the coiled wire is wound up in torsion through rotation of the switch handle, upon release of the rotative force, the wound-up wire biases the switch handle away from the momentary switch position.

Rotary electric switches having a momentary switch position of the type described above often experience numerous disadvantages.

As a first disadvantage, it has been found that rotary electric switches of the type described above require that one stationary contact be removed from the switch in order to provide a region of the recessed base in which the coiled wire can be disposed to accommodate the momentary switch position. As a result, the switch is deprived of a stationary switch position.

As a second disadvantage, it has been found that rotary electric switches of the type described above are difficult to manufacture. Specifically, because a coiled wire is disposed between the rotor and the recessed base, the assembly process becomes increasingly complicated. In particular, it has been found that, during assembly, the coiled wire often becomes tangled with the stationary contacts disposed on the recessed base.

As a third disadvantage, it has been found that rotary electric switches of the type described above are unreliable. Specifically,. because a coiled wire is disposed between the rotor and the recessed base, the rotor is often thinned-out in thickness to accommodate the coil. As a result, the rotor is weakened and is susceptible to failure.

As a fourth disadvantage, it has been found that rotary electric switches of the type described above are difficult to use. Specifically, because the coiled wire must be wound up in torsion in order to experience the momentary switch setting, the user is required to expend a significant amount of energy to load the wire.

SUMMARY OF THE INVENTION

It is an object of the present invention to provide a new and improved rotary electric switch.

It is another object of the present invention to provide a rotary electric switch which includes push-in wire type terminals.

It is yet another object of the present invention to provide a rotary electric switch as described above which provides stable state positions and at least one momentary switch position.

It is still another object of the present invention to provide a rotary electric switch as described above which can be mass produced, has a minimal number of parts, which is limited in size and can be very easily used.

Accordingly, there is provided a rotary electric switch comprising a hollow housing, said hollow housing having a recessed base and a cover member, a plurality of stationary contacts seated on the recessed base, a switch handle rotably mounted on the base of said housing, said switch handle being disposed between said plurality of stationary contacts, said switch handle comprising a disc-shaped rotor having a top surface and a bottom surface, said switch handle being rotatable between a first position and a second position, a rotatable contactor mounted on the bottom surface of the rotor of said switch handle for selectively contacting said stationary contacts, and a coiled wire mounted on the top surface of the rotor of said switch handle, said coiled wire contacting the cover member of said hollow housing when a force is applied to rotate said switch handle to its first position, said coiled wire urging said switch handle away from its first position upon the release of the applied force on said switch handle.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts:

FIG. 12(*b*) is a top view of the coiled wire shown in FIG. 2, the coiled wire being shown in its pre-loaded position;

FIG. 13(*b*) is a top view of the switch handle shown in FIG. 2, the switch handle being shown with the coiled wire mounted thereon in its pre-loaded position.

DETAILED DESCRIPTION OF A PREFERRED EMBODIMENT

Figure 2:
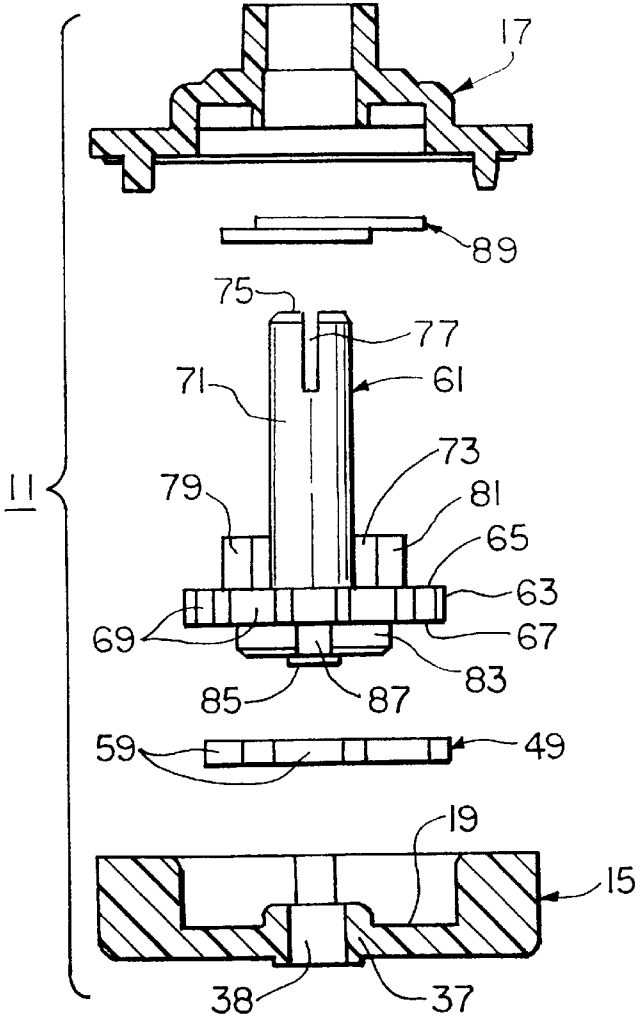
FIG. 2 is an exploded front view of the rotary electrical switch shown in FIG. 1, the switch being shown without the stationary contacts and the shunt plates, the hollow housing being shown in lateral cross-section.
Figure 1:
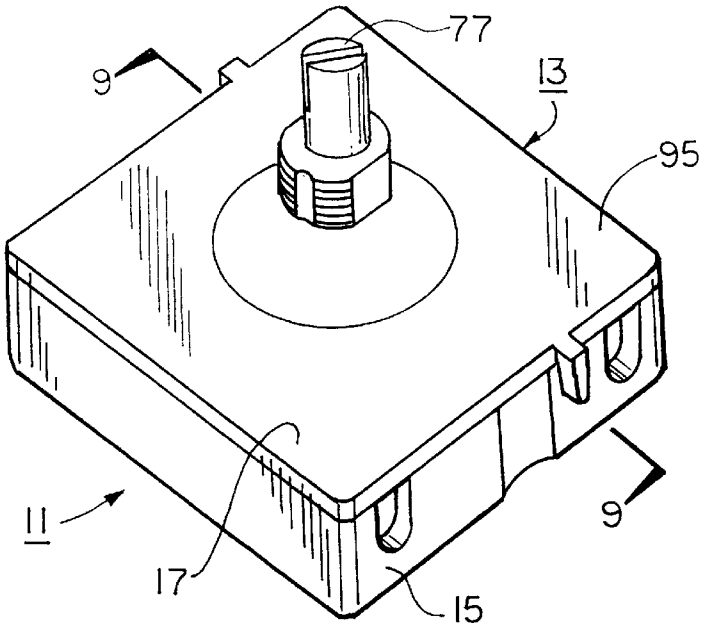
FIG. 1 is a top perspective view of a rotary electric switch constructed according to the teachings of the present invention.
Figure 3:
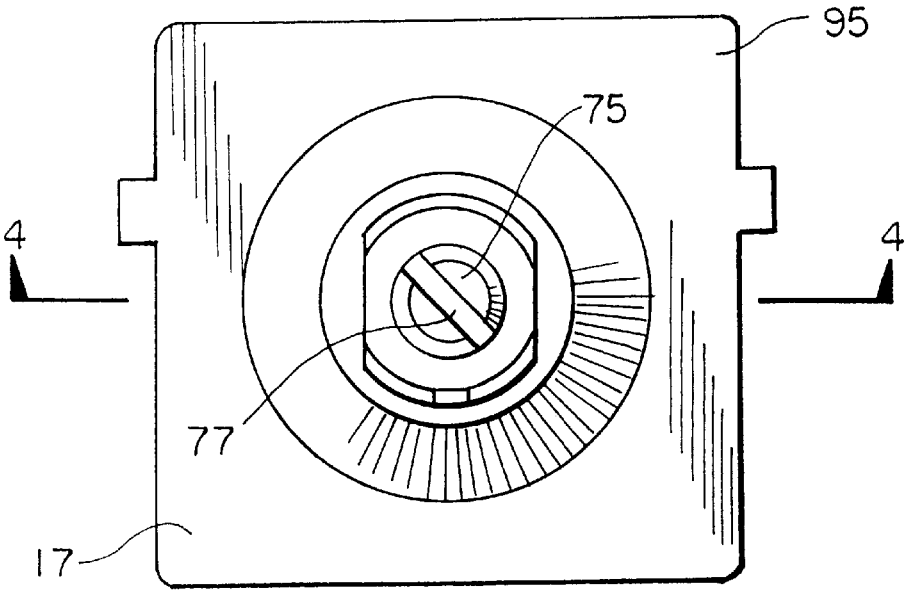
FIG. 3 is a top plan view of the rotary electric switch shown in FIG. 1.
Figure 4:
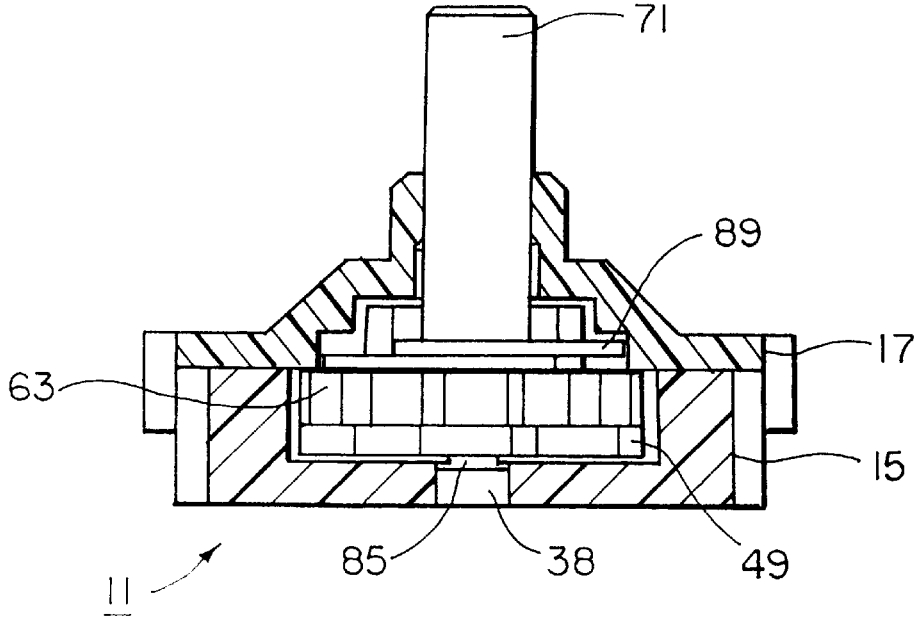
FIG. 4 is a sectional view of the rotary electric switch shown in FIG. 3, taken along lines 4—4.

Referring now to the drawings, there is shown a rotary electric switch constructed according to the teachings of the present invention, the rotary electric switch being represented generally by reference numeral 11. As will be described further in detail below, switch 11 is constructed to include a plurality of stable state switching positions and at least one momentary switch position.

Switch 11 comprises a hollow housing 13 constructed of plastic or other suitable insulating material. Housing 13 includes a recessed base 15 and a cover member 17, recessed base 15 and cover member 17 being permanently attached together, such as by ultrasonic welding, to make switch 11 a unitary device.

Figure 5:
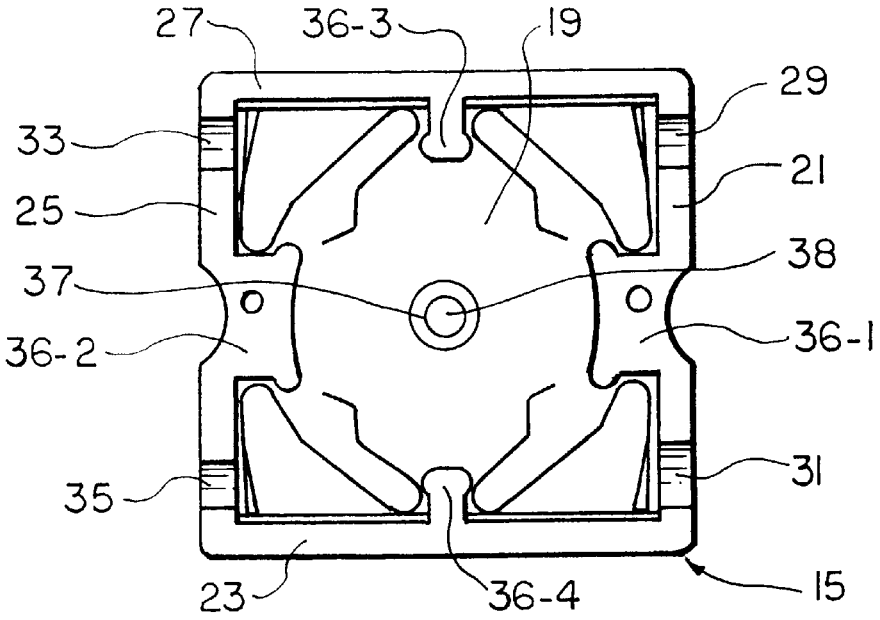
FIG. 5 is a top plan view of the base shown in FIG. 2, the base being shown with the fixed contacts and the conductive plates disposed therein.

Recessed base 15 is generally rectangularly shaped and includes a bottom wall 19 and four sidewalls 21, 23, 25 and 27, as shown in FIG. 5. Sidewall 21 includes a pair of conductor wire-receiving openings 29 and 31 and sidewall 25, which is opposite sidewall 21, includes a pair of conductor wire receiving openings 33 and 35. Base 15 also includes a pair of first partitions 36-1 and 36-2 and a pair of second partitions 36-3 and 36-4 integrally formed therein. Bottom wall 19 of base 15 includes an integrally formed annular boss 37 which is shaped to define a central bore 38 therethrough.

Figure 6:
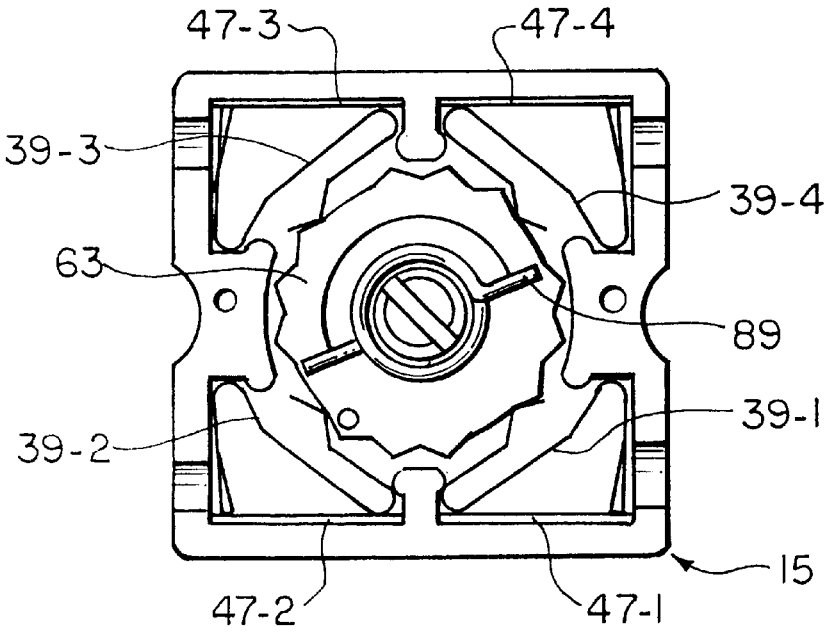
FIG. 6 is a top plan view of the rotary electric switch shown in FIG. 3, the switch being shown with the cover member removed.
Figure 7:
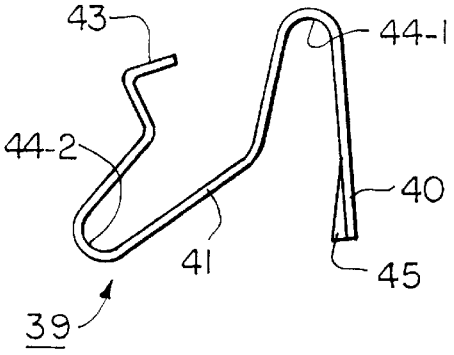
FIG. 7 is an enlarged, top plan view of one of the fixed contacts shown in FIG. 5.

Switch 11 further comprises four resilient stationary contacts 39-1 through 39-4 constructed preferably of bronze, one resilient stationary contact 39 being positioned at each corner of recessed base 15 between first partitions 36-1 and 36-2 and second partitions 36-3 and 364, as shown in FIGS. 5 and 6. Each resilient stationary contact 39 is generally Z-shaped and comprises a locking tongue 40 at one end, an intermediate arm 41, and a spring finger 43 at the opposite end from locking tongue 40, as shown in FIG. 7. Locking tongue 40 is joined to arm 41 at a first bend 44-1 and arm 41 is joined finger 43 at a second bend 44-2.

Contact 39-1 is positioned in recessed base 15 between partition 36-1 and 36-4 so that the free end of its locking tongue 40 overlies conductor wire-receiving opening 31. Locking tongue 40 includes a V-shaped groove 45 at the free end thereof, groove 45 facing outwardly towards opening 31. Resilient stationary contacts 39-2 through 39-4 are positioned at the other three corners of base 15 in a similar manner.

Switch 11 further comprises four conductive plates 47-1 through 47-4 constructed preferably of brass. Conductive plate 47-1 is seated inside base 15 along sidewall 23, between sidewall 21 and partition 364. Plate 47-1 is positioned so as to be in contact with contact 39-1 around bend 44-2. Plates 47-2 through 47-4 are seated in base 15 in a similar manner so as to be in contact with contacts 39-2, 39-3 and 39-4, respectively.

Switch 11 additionally comprises a rotatable contactor 49 constructed of a conductive material such as copper or brass. Rotatable contactor 49 is generally annular shaped and flat and comprises an inner wall 51 shaped to define a central opening 53 and an outer periphery 55. Inner wall 51 of rotatable contactor 49 is shaped to include a plurality of engagement tabs 57 which extend inwardly into central opening 53. In addition, outer periphery 55 of rotatable contactor 49 is shaped to include a plurality of contact projections 59. As will be discussed further in detail below, projections 59 serve the purpose of making or breaking a connection with spring fingers 43 of stationary contacts 39 to form an open or closed circuit, respectively.

Switch 11 further comprises a switch handle 61 constructed out of a material such as plastic or nylon. Switch handle 61 comprises a generally disc-shaped rotor 63 having a top surface 65, a bottom surface 67 and a plurality of detent notches 69 formed along its periphery.

Figure 13A:
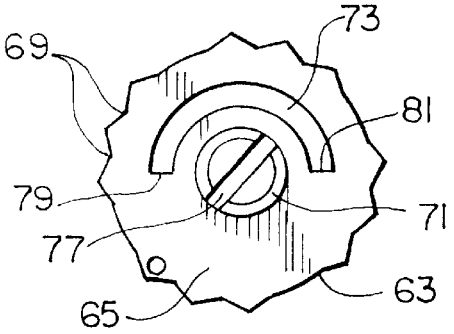
FIG. 13(*a*) is a top view of the switch handle shown in FIG. 2.
Figure 13B:
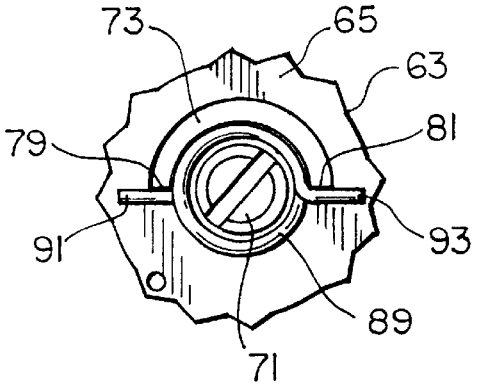

Switch handle 61 also comprises an elongated shaft 71 and a rotor stop 73 which are integrally formed onto top surface 65 of rotor 63, as shown in FIG. 2. Specifically, shaft 71 is generally cylindrical in shape comprises a free end 75 which includes a lateral slot 77 formed therein. Rotor stop 73 is generally arcuate in shape and is formed on top surface 65 of rotor 63 around shaft 71. As shown in FIG. 13(*a*), rotor stop 73 extends approximately 180 degrees around shaft 71 and includes a first end 79 and a second end 81.

Figure 10:
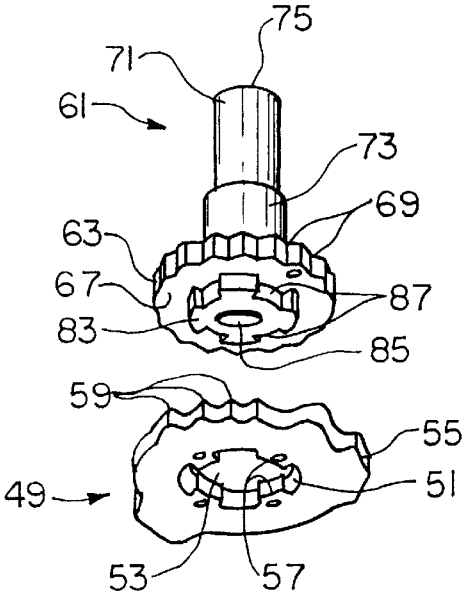
FIG. 10 is an exploded, bottom perspective view of the switch handle and rotatable contact shown in FIG. 2.
Figure 11:
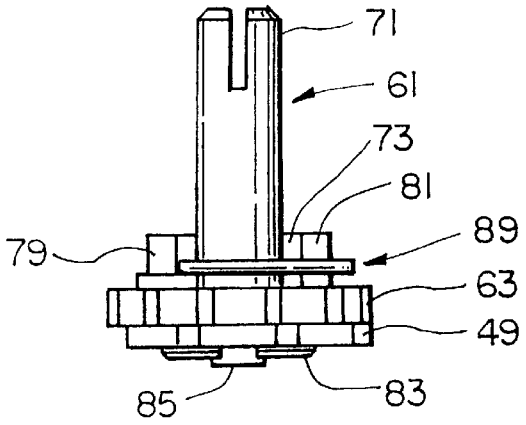
FIG. 11 is a front view of the switch handle shown in FIG. 2, the switch handle being shown with the coiled wire and rotatable contactor mounted thereon.

As shown in FIG. 10, switch handle 61 further comprises a generally disc-shaped projection 83 and a mounting post 85 which are integrally formed onto bottom surface 67 of rotor 63. Specifically, disc-shaped projection 83 protrudes out from bottom surface 67 and comprises four detent notches 87 formed along its periphery. Detent notches 87 on projection 83 are sized and shaped to engage tabs 57 of rotatable contact 49, thereby enabling rotatable contact 49 to be securely mounted on bottom surface 67 of rotor 63, as shown in FIG. 11. Mounting post 85 is generally cylindrical in shape and is sized so as to be pivotally mounted into bore 38 formed in base 15.

Figure 12A:
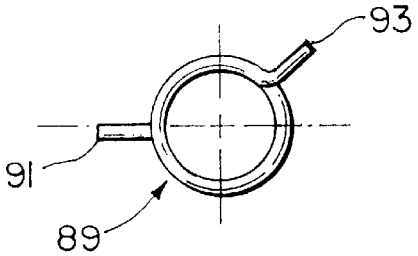
FIG. 12(*a*) is a top view of the coiled wire shown in FIG. 2, the coiled wire being shown in its free state position.
Figure 12B:
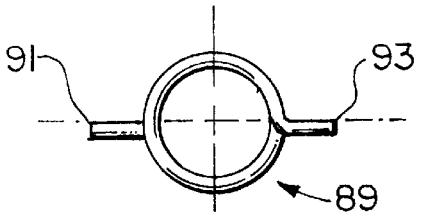

Switch 11 further comprises a coiled wire 89 manufactured of a resilient material such as music wire. Coiled wire 89 is shaped to include a first free end 91 and a second free end 93. Referring now to FIG. 12(*a*), coiled wire 89 is shown in its free state position. The free state position of coiled wire 89 refers to the natural position wire 89 assumes without any outside forces applied thereto. Positioned as such, first free end 91 and second free end 93 are approximately 130 degrees apart. Referring now to FIG. 12(*b*), coiled wire 89 is shown in its pre-loaded position. The pre-loaded position of coiled wire 89 refers to the position wire 89 assumes when it is wound up in torsion. Positioned as such, first free end 91 and second free end 93 are approximately 180 degrees apart.

Referring now to FIGS. 11 and 13(*b*), coiled wire 89 is shown mounted on top surface 65 of rotor 63 around shaft 71 and within rotor stop 73. It should be noted that arcuate rotor stop 73 serves to maintain coiled wire 89 in its pre-loaded position. Specifically, first end 79 and second end 81 of rotor stop 73 serve to maintain first end 91 and second end 93 of coiled wire 89 in its pre-loaded position.

It should be noted that maintaining coiled wire 89 in a pre-loaded position is highly desirable for it decreases the amount of rotative force required to move switch 11 into its momentary switch position, as will be described further in detail below.

It should also be noted that mounting coiled wire 89 on top surface 65 of rotor 63 introduces numerous advantages. As a first advantage, mounting coiled wire 89 on top surface 65 of rotor 63 serves eliminate the need for one stationary contact 39 to be removed from switch 11 in order to provide a region in recessed base 15 in which coiled wire 89 can be disposed, thereby increasing the potential number of stable state switching positions for switch 11. As a second advantage, mounting coiled wire 89 on top surface 65 of rotor 63 serves to prevent coiled wire 89 from becoming tangled with stationary contacts 39 disposed in base 15, thereby simplifying the assembly process. As a third advantage, mounting coiled wire 89 on top surface 65 or rotor 63 serves to eliminate the need to thin out the thickness of rotor 63 to enable coiled wire 89 to be disposed between rotor 63 and base 15, thereby increasing the overall strength of rotor 63.

Figure 8:
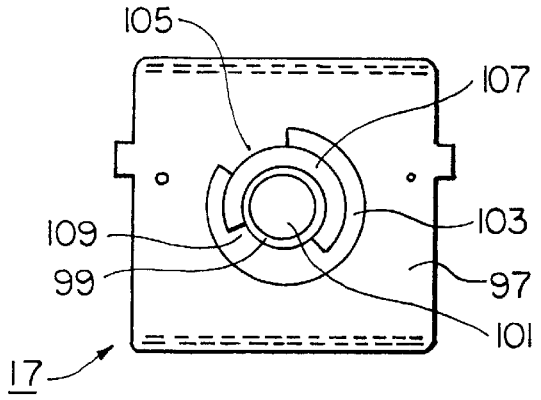
FIG. 8 is a bottom plan view of the cover member shown in FIG. 1.
Figure 9:
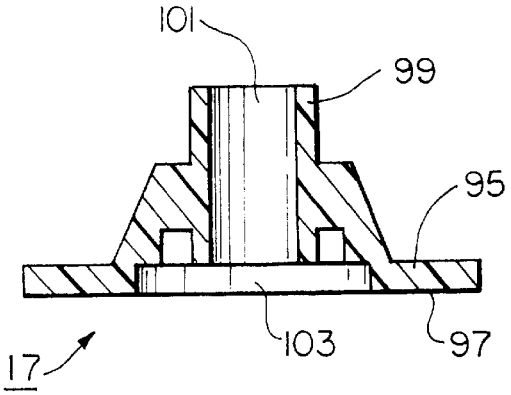
FIG. 9 is a sectional view of the cover member shown in FIG. 1, taken along lines 9—9.

Cover member 17 of housing 13 is generally rectangularly shaped and comprises a top surface 95, a bottom surface 97 and an integrally formed annular boss 99 which is shaped to define a central bore 101 therethrough. Referring now to FIGS. 8 and 9, a generally annularly-shaped coiled wire recess 103 is formed in bottom surface 97. A coiled wire stop member 105 is disposed within coiled wire recess 103, coiled wire stop member 105 being integrally formed and flush with bottom surface 97. In use, coiled wire 89 is disposed within coiled wire recess 103 in cover member 17 and travels therethrough upon rotation of switch handle 61, coiled wire stop member 105 limiting the range of motion of coiled wire 89.

In addition, a generally annularly-shaped rotor recess 107 is formed in bottom surface 97. Rotor recess 107 is disposed within and at depth below coiled wire recess 103. A rotor stop member 109 is disposed within rotor recess 107, rotor stop member 109 being integrally formed and flush with coiled wire recess 103. In use, rotor stop 73 formed on rotor 63 is disposed within rotor recess 107 and travels therethrough upon rotation of switch handle 61, rotor recess stop member 109 limiting the range of motion of rotor stop 73, and subsequently, rotor 63 of switch handle 17.

In use, switch 11 can be used in the following manner to provide an off position, one momentary switch position and multiple stable state switching positions. Switch 11 comprises an off setting, referred to as position 2 in FIG. 14, in which an open circuit is formed between all four stationary contacts 39. Specifically, with switch handle 61 orientated in its off setting, projections 59 in rotatable contactor 49 contact only stationary contact 39-2, thereby creating an open circuit between all four stationary contacts 39.

Figure 14:
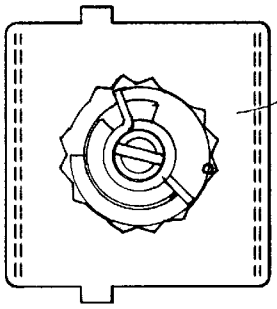
FIG. 14 is a diagrammatic view showing the different switch positions for the rotary electrical switch of the present invention.
Figure 14:
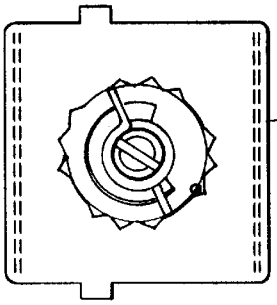
Figure 14:
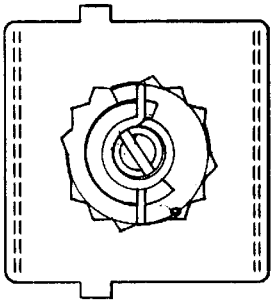
Figure 14:
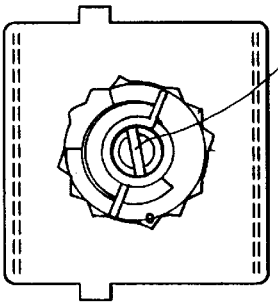
Figure 14:
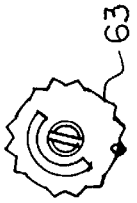
Figure 14:
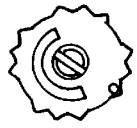
Figure 14:
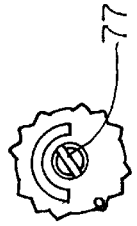
Figure 14:
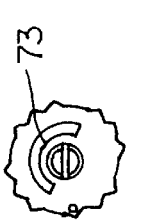
Figure 14:
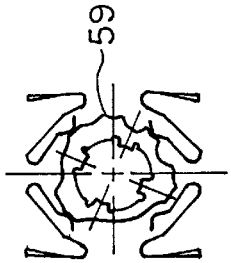
Figure 14:
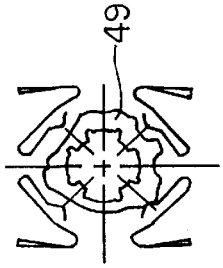
Figure 14:
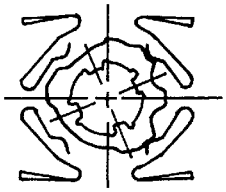
Figure 14:
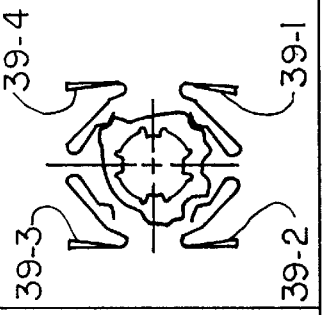

Switch handle 61 can be rotated in a counterclockwise direction from the off setting and into a momentary, or pulse, setting for switch 11, the momentary switch setting being referred to as position 1 in FIG. 14. With switch handle 61 orientated in its momentary switch setting, projections 59 in rotatable contactor 49 contact stationary contacts 39-1, 39-3 and 39-4, thereby creating a closed circuit therebetween. It should be noted that the application of a counterclockwise force on switch handle 61 from the off setting causes second free end 93 of coiled wire 89 to engage coiled wire stop member 105. Continued application of a counterclockwise rotative force on switch handle 61 until switch 11 is set in its momentary switch setting causes coiled wire 89 to further wind up in torsion. Energy continues to be stored in coiled wire 89 as long as the counterclockwise rotative force is applied to position switch handle 61. Upon release of the counterclockwise rotative force to switch handle 61, coiled wire 89 will return to its pre-loaded position, the energy stored within coiled wire 89 being released to rotate switch handle 61 in a clockwise direction until switch 11 returns to its off setting.

As can be appreciated, by pre-loading coiled wire 89 on rotor 63, a minimal counterclockwise rotative force is required to position switch handle 61 in its momentary switch setting, which is desirable.

Switch handle 61 can be rotated in a clockwise direction from the off setting and into a low power setting for switch 11, the low power setting being referred to as position 3 in FIG. 14. With switch handle 61 orientated in its low power setting, projections 59 in rotatable contactor 49 contact stationary contacts 39-1 and 39-2, thereby creating a closed circuit therebetween. It should be noted that, with switch handle 61 orientated in its low power setting, spring fingers 43 of stationary contacts 39 engage detent notches 69 so as to lockably maintain switch handle 61 in the low power setting even after the clockwise rotative force is removed.

Switch handle 61 can be further rotated in a clockwise direction from the low power setting and into a high power setting for switch 11, the high power setting being referred to as position 4 in FIG. 14. With switch handle 61 orientated in its high power setting, projections 59 in rotatable contactor 49 contact stationary contacts 39-1 and 39-4, thereby creating a closed circuit therebetween. It should be noted that, with switch handle 61 orientated in its high power setting, spring fingers 43 of stationary contacts 39 engage detent notches 69 so as to lockably maintain switch handle 61 in the high power setting even after the clockwise rotative force is removed. It should also be noted that, with switch handle 61 orientated in its high power setting, rotor stop 73 of switch handle 61 abuts against rotor stop member 109 formed in cover member 17 to preclude further rotation of switch handle 61 in a clockwise direction.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A rotary electric switch comprising:

a. a hollow housing, said hollow housing having a recessed base and a cover member;

b. a plurality of stationary contacts seated on the recessed base;

c. a switch handle rotably mounted on the base of said housing, said switch handle being disposed between said plurality of stationary contacts, said switch handle comprising a disc-shaped rotor having a top surface and a bottom surface, said switch handle being rotatable between a first position and a second position;

d. a rotatable contactor mounted on the bottom surface of the rotor of said switch handle for selectively contacting said stationary contacts; and e. a coiled wire mounted on the top surface of the rotor of said switch handle, said coiled wire contacting the cover member of said hollow housing when a force is applied to rotate said switch handle to the first position, said coiled wire urging said switch handle away from the first position upon the release of the applied force on said switch handle.

2. The rotary electric switch of claim 1 wherein said switch handle further comprises an elongated shaft and an arcuate rotor stop which are formed on the top surface of the rotor.

3. The rotary electric switch of claim 2 wherein said coiled wire comprises a first free end a second free end.

4. The rotary electric switch of claim 3 wherein said coiled wire is mounted on the top surface of the rotor of said switch handle with first and second free ends of said coiled wire abutting against the arcuate rotor stop on said switch handle so as to maintain said coiled wire in a pre-loaded position.

5. The rotary electric switch of claim 4 wherein said cover member comprises a top surface, a bottom surface and an annular boss which is shaped to define a central bore therethrough.

6. The rotary electric switch of claim 5 wherein said cover member comprises a coiled wire recess formed in the bottom surface and a coiled wire stop member disposed within the coiled wire recess, said coiled wire traveling within said coiled wire recess upon rotation of said switch handle.

7. The rotary electric switch of claim 6 wherein said coiled wire stop member is flush with the bottom surface of said cover member.

8. The rotary electric switch of claim 6 wherein said cover member comprises a rotor recess formed in the bottom surface and a rotor stop member disposed within the rotor recess, said rotor recess being formed in the bottom surface of said cover member at a depth greater than the coiled wire recess, the arcuate rotor stop formed on the top surface of the rotor traveling within said rotor recess upon rotation of said switch handle.

9. The rotary electric switch of claim 8 wherein said switch handle further comprises a generally disc-shaped projection and a mounting post which are formed onto the bottom surface of the rotor.

10. The rotary electric switch of claim 9 wherein said rotatable contactor is annularly shaped and comprises an inner wall shaped to define a central opening and an outer periphery, the inner wall being shaped to include a plurality of engagement tabs, the outer periphery being shaped to include a plurality of contact projections, the plurality of engagement tabs engaging the disc-shaped projection on said switch handle so as to mount said rotatable contactor on the bottom surface of the rotor on said switch handle.

11. The rotary electric switch of claim 10 wherein said base comprises a plurality of wire receiving openings and an annular boss shaped to define a central bore into which the mounting post of the switch handle is disposed.

12. The rotary electric switch of claim 11 wherein each of said plurality of stationary contacts are generally Z-shaped and comprise a locking tongue at one end, an intermediate arm, and a spring finger at an opposite end from the locking tongue, each stationary contact being positioned in said base with the locking tongue overlying a wire receiving opening in said base.

13. The rotary electric switch of claim 12 wherein the rotor of said switch handle comprises a plurality of detent notches formed along a periphery which are sized and shaped to engage the spring finger of said plurality of stationary contacts to lock said switch handle in place when said switch handle is rotated to the second position.

14. The rotary electric switch of claim 13 further comprising a plurality of conductive plates seated in said base, one conductive plate being associated with each stationary contact and contacting said stationary contact at a location on the intermediate arm.

* * * * *